US006684770B2

(12) United States Patent
Kamen et al.

(10) Patent No.: US 6,684,770 B2
(45) Date of Patent: Feb. 3, 2004

(54) APPARATUS AND METHOD FOR DIRECT ROTARY PRINTING COMPOSITIONS ONTO CYLINDRICAL ARTICLES

(75) Inventors: Melvin E. Kamen, Edison, NJ (US); Marvin Wells, East Windsor, NJ (US); Jerry Schuler, Hamilton, IL (US)

(73) Assignee: Deco Patents, Inc., Edison, NJ (US)

( * ) Notice: Subject to any disclaimer, the term of this patent is extended or adjusted under 35 U.S.C. 154(b) by 0 days.

(21) Appl. No.: 10/183,180

(22) Filed: Jun. 26, 2002

(65) Prior Publication Data

US 2003/0121428 A1 Jul. 3, 2003

Related U.S. Application Data

(60) Provisional application No. 60/302,057, filed on Jun. 29, 2001.

(51) Int. Cl.[7] ..... B41F 15/12

(52) U.S. Cl. ..... 101/129; 101/38.1; 101/40; 101/119; 101/120

(58) Field of Search ..... 101/114, 119, 101/120, 123, 124, 129, 40, 38.1

(56) References Cited

U.S. PATENT DOCUMENTS

| | | | |
|---|---|---|---|
| 1,066,488 | A | 7/1913 | Ginaca |
| 2,009,098 | A | 7/1935 | Smith et al. |
| 2,134,041 | A | 10/1938 | Hamm |
| 2,160,725 | A | 5/1939 | Flint |
| 2,276,181 | A | 3/1942 | Foster |
| 2,327,668 | A | 8/1943 | Rempel |
| 2,881,699 | A | 4/1959 | Hakogi |
| 3,139,817 | A | 7/1964 | Terry, Jr. |
| 3,425,343 | A | 2/1969 | Jaeger |
| 3,425,344 | A | 2/1969 | Jaeger |
| 3,487,775 | A | 1/1970 | Chaney et al. |
| 3,518,938 | A | 7/1970 | Donner et al. |
| 3,543,680 | A | 12/1970 | Killen et al. |
| 3,564,998 | A | 2/1971 | Johnson et al. |
| 3,598,049 | A | 8/1971 | De Souza Dias |
| 3,783,777 | A | 1/1974 | Killen et al. |
| 3,816,207 | A | 6/1974 | Robertson et al. |
| 3,933,091 | A | 1/1976 | Von Saspe |
| 4,005,649 | A | 2/1977 | Strauch et al. |
| 4,026,208 | A | 5/1977 | Horne, Jr. et al. |
| 4,068,579 | A | 1/1978 | Poo et al. |
| 4,091,726 | A | 5/1978 | Walker |
| 4,176,598 | A | 12/1979 | Dubuit |
| 4,263,846 | A | 4/1981 | Eldred et al. |
| 4,282,806 | A | 8/1981 | Lala |
| 4,352,326 | A | 10/1982 | Kammann |
| 4,380,955 | A | 4/1983 | Okura |
| 4,434,714 | A | 3/1984 | Combeau |
| 4,440,589 | A | 4/1984 | Lock |
| 4,480,540 | A | 11/1984 | Lock et al. |

(List continued on next page.)

FOREIGN PATENT DOCUMENTS

| | | |
|---|---|---|
| EP | 0 677 364 B1 | 5/1998 |

*Primary Examiner*—Ren Yan
(74) *Attorney, Agent, or Firm*—Lerner, David, Littenberg, Krumholz & Mentlik, LLP

(57) ABSTRACT

An apparatus includes a rotary printing assembly operative for directly printing a layer of radiation curable material onto the cylindrical surface of individual articles. The rotary printing assembly includes a rotationally supported belt defining an interior region, the belt having a planar portion for contact with the cylindrical surface of the articles for directly printing a layer of the radiation curable material thereon. At least one squeegee is arranged within the interior region of the belt having a portion engaging the belt for contacting the planar portion of the belt with the cylindrical surface of the article. The squeegee is moveable longitudinally within the interior region of the belt during the printing operation. A radiation emitting device can be positioned adjacent the rotary printing assembly for at least partially curing the layer of radiation curable material applied to the articles.

59 Claims, 8 Drawing Sheets

U.S. PATENT DOCUMENTS

| | | | |
|---|---|---|---|
| 4,519,310 | A | 5/1985 | Shimizu et al. |
| 4,628,857 | A | 12/1986 | Coningby |
| 4,729,305 | A | 3/1988 | Spencer |
| 4,798,135 | A | 1/1989 | Meredith |
| 4,885,992 | A | 12/1989 | Duce |
| 5,207,156 | A | 5/1993 | Helling |
| 5,247,882 | A | 9/1993 | Zook et al. |
| 5,317,967 | A | 6/1994 | Heidenreich |
| 5,357,856 | A | 10/1994 | Hasegawa et al. |
| 5,372,064 | A | 12/1994 | Dubuit et al. |
| 5,434,804 | A | 7/1995 | Bock et al. |
| 5,471,924 | A | 12/1995 | Helling |
| 5,477,781 | A | 12/1995 | Stefani |
| 5,487,927 | A | 1/1996 | Kamen et al. |
| 5,524,535 | A | 6/1996 | Strutz et al. |
| 5,571,359 | A | 11/1996 | Kamen et al. |
| 5,656,336 | A | 8/1997 | Kamen et al. |
| 5,953,988 | A | 9/1999 | Vinck |
| 5,985,376 | A | 11/1999 | Kamen |
| 6,093,455 | A | 7/2000 | Kamen et al. |
| 6,283,022 | B1 | 9/2001 | Kamen et al. |

APPARATUS AND METHOD FOR DIRECT ROTARY PRINTING COMPOSITIONS ONTO CYLINDRICAL ARTICLES

CROSS-REFERENCE TO RELATED APPLICATIONS

The present application claims the benefit of U.S. Provisional Application No. 60/302,057, filed Jun. 29, 2001, the disclosure of which is hereby incorporated by reference herein.

BACKGROUND OF THE INVENTION

The present invention relates in general to decorating technology applicable to cylindrical articles using direct rotary printing of compositions in various predetermined patterns and registrations. Still more particularly, the present invention is directed to an apparatus and method for decorative direct rotary printing of various cylindrical articles such as glassware and the like with radiation curable compositions such as ultraviolet radiation (UV) and the like.

In the glassware decorating industry, there exists the desire to apply one or more layers of a suitable material in various predetermined patterns to an article for decorative or other purposes. One of the important commercial applications today is in the printing of bottles having a generally cylindrical configuration. The term "cylindrical" as used herein is intended to cover articles, e.g., bottles, which have at least one portion which is characterized by a cylindrical cross-sectional shape, e.g., substantially circular or round. The aforementioned bottles have found a wide variety of applications, for example, cosmetics, perfumes, food products, household and personal cleansing products, etc. One application which is believed to dominate the present market in terms of volume is beverage bottles for both soft and alcoholic beverages.

There is known a variety of apparatuses for decorating bottles with multiple colored printing inks for forming decorative predetermined patterns and/or textured material. For example, it has been common practice to decorate cylindrical shaped bottles using a screen printing apparatus which includes a conventional reciprocating screen or squeegee printing assembly. In the known reciprocating screen printing assembly, a generally rectangular frame supports a patterned screen which carries the printing ink to be screen printed onto the underlying article by means of a squeegee. In one such type of screen printing assembly, the screen is held stationary while the squeegee is moved across the surface of the screen in order to force the printing ink through the screen thereby creating the desired pattern. In another screen printing assembly, the screen is reciprocated laterally while maintaining the squeegee stationary in engagement with the surface of the screen. Illustrative of the aforementioned screen printing assembly are those disclosed in Poo, et al., U.S. Pat. No. 4,068,579; Walker, U.S. Pat. No. 4,091,726; Eldred, et al., U.S. Pat. No. 4,263,846; Lala, U.S. Pat. No. 4,282,806; Cammann, U.S. Pat. No. 4,352,326; Okura, U.S. Pat. No. 4,380,955; Combeau, U.S. Pat. No. 4,434,714; Heidenreich, U.S. Pat. No. 5,317,967; Carlyn, et al., U.S. Pat. No. 5,343,804; and Strutz, et al., U.S. Pat. No. 5,524,535.

In addition to the aforementioned reciprocating screen printing assemblies, there is known from Von Saspe, U.S. Pat. No. 3,933,091 a screen printing apparatus employing a stationary semi-circular printing screen using a rotatable squeegee assembly having a plurality of squeegees. There is further known from Coningsby, U.S. Pat. No. 4,628,857, a screen printing apparatus including a horizontally arranged rotary screen printing assembly. The screen printing assembly is operative for printing a non-continuous coating on a substrate of various shapes such as cylindrical, conical or oval, in particular, slender-like articles such as writing implements. The screen printing assembly is in the nature of a cylindrical hollow printing drum provided with an opening for accommodating a patterned screen. The interior of the drum includes a squeegee and a supply of printing ink. Articles to be screen printed are placed on a conveyor and moved to a position underlying the screen at which time the article is lifted by an elevator mechanism into engagement with the continuously rotating screen printing drum.

In Duce, U.S. Pat. No. 4,885,992 there is disclosed a vertically arranged indirect rotary screen printing assembly particularly adapted for printing spark plug insulators. The screen printing assembly includes a vertically arranged screen printing drum provided with a printing screen and an internal squeegee. The screen is arranged in contact with a transfer roller having a transfer surface. The image to be transferred is first applied to the transfer surface and, upon rotation of the transfer roller, to the surface of the intended article such as the spark plug insulator. The use of a vertical screen printing assembly avoids having to index articles to be printed from an initial vertical supply orientation to a horizontal printing orientation, and then back again to a vertical discharge orientation. Other bottle screen printing apparatuses are known from Helling, U.S. Pat. No. 5,471,924 and Strauch, et al., U.S. Pat. No. 4,005,649.

The economics of the bottle screen printing industry are directly related to production rate. Conventional reciprocating screen printing assemblies are known to achieve production rates of only about 180 bottles per minute. In the lucrative beverage bottle decorating industry, it is desirable to obtain production rates of at least 250 bottles per minute, and preferably 500–700 bottles per minute, and optimally up to 1000 bottles per minute. These production rates cannot be achieved by the aforementioned reciprocating screen printing assemblies. In addition, the conventional reciprocating screen printing assemblies, due to their stroke length, e.g., up to about 36 inches, occupy a substantial space within the screen printing apparatus. As a result, the space provided for curing the screen printed ink is often inadequate, rendering the aforementioned screen printing apparatus generally undesirable for multi-colored screen printing operations where curing may be desired between screen printing workstations, and in particular, where high production rates are desired. This becomes more significant when screen printing multiple registered layers of a printing ink which requires overprinting of one layer with the next layer without the adverse consequences of streaking of the previously applied layer.

In Von Saspe, production rates of up to 220 bottles per minute are disclosed using the stationary semi-circular screen printing assembly. However, the screen printing apparatus of Von Saspe requires multiple drying tunnels which occupy a large portion of the screen printing apparatus, and hence, floor space which might not always be available.

A number of the aforementioned disadvantages from the known screen printing apparatus are overcome by the screen printing apparatus disclosed in U.S. Pat. No. 5,985,376, and assigned to the same assignee of the present application, the disclosure of which is incorporated herein by reference. The disclosed reciprocating screen printing apparatus arranges a UV radiation source opposing the printing screen at each screen printing workstation. Articles to be decorated are positioned between the UV radiation source and the printing screen. Each article is printed with an image formed from a UV curable composition by being rolled across the printing screen. The UV radiation source is positioned so that as the applied image is transferred to the article, UV radiation is incident upon the article's surface as it rolls away from the printing screen with the newly transferred image. The image is exposed to the UV radiation for a sufficient duration such that a cured skin forms on the surface of the transferred image of sufficient strength to support the next layer to be applied to the article. The disclosed screen printing apparatus has a production rate of up to about 180 bottles per minute.

Notwithstanding the known screen printing apparatus, there remains a need for further improvements in printing apparatuses and decorating methods therefore which are operable for printing, for example, UV curable compositions, in various patterns and/or registered layers directly onto articles having cylindrical portions at a production rate heretofore unknown from the prior art, while at the same time, allowing for the at least partial cure of the radiation curable composition between one or more screen printing workstations. By way of example, such improvements are disclosed in U.S. patent application Ser. No. 09/166,811, filed on Oct. 6, 1998 and assigned to the same assignee of the present invention, the disclosure of which is incorporated herein by reference.

SUMMARY OF THE INVENTION

The rotary screen printing assembly of the present invention differs from the reciprocating shuttle-type screen printing assemblies in that the printing screen rotates, as opposed to shuttling back and forth in a horizontal plane. This enables the rotary screen printing assembly to occupy a smaller space within the apparatus, as well as to provide increased production rates.

In accordance with one embodiment of the present invention there is disclosed an apparatus for printing a layer of radiation curable material onto individual articles having a cylindrical surface. The apparatus includes a rotary printing assembly operative for directly printing a layer of radiation curable material onto the cylindrical surface of individual articles. The rotary printing assembly includes a rotationally supported belt defining an interior region, the belt having a planar portion for contact with the cylindrical surface of the articles for directly printing a layer of the radiation curable material thereon. At least one squeegee is arranged within the interior region of the belt having a portion engaging the belt for contacting the planar portion of the belt with the cylindrical surface of the article. The squeegee in the preferred embodiment is moveable longitudinally within the interior region of the belt during the printing operation. A radiation emitting device can be positioned adjacent the rotary printing assembly for at least partially curing the layer of radiation curable material applied to the articles. The articles are transported by a transporting assembly into operative relationship with the rotary printing assembly and the radiation emitting device. The transporting assembly includes a plurality of fixtures for releasably securing the articles and which are operative for rotating the articles when at least in operative association with the planar portion of the rotary printing assembly.

In accordance with another embodiment of the present invention there is disclosed a process for directly applying a layer of radiation curable material onto individual articles having a cylindrical surface. The process includes conveying the articles into operative association with a rotary printing assembly including a rotationally supported belt defining an interior region, the belt having a planar portion for contact with the cylindrical surface of the articles for directly printing a layer of radiation curable material thereon. At least one squeegee within the interior region of the belt engages the belt for contacting the planar portion of the belt with the cylindrical surface of the article. The squeegee in the preferred embodiment is moveable longitudinally within the interior region of the belt during the printing operation. The articles are rotated when in operative contact with the planar portion of the belt, while directly printing a layer of radiation curable material from the planar portion of the belt onto the cylindrical surface of the articles. The printed layer on the articles is exposed to radiation sufficient to at least partially cure the printed layer.

An apparatus for printing a layer of material onto individual articles having a curved surface, the apparatus comprising a rotationally supported printing belt in the shape of a loop, the belt having an inner surface defining an interior region, a rotationally supported squeegee belt in the shape of a loop within the interior region, and at least one squeegee attached to the squeegee belt, the squeegee having a distal portion in operative association with the inner surface of the printing belt adapted for printing the material onto the surface of the articles.

An apparatus for direct rotary printing a layer of radiation curable material onto a curved surface of individual articles, the apparatus comprising a continuous loop shaped printing belt having an inner surface defining an interior space and an outer surface arranged in a vertical plane, a printing belt drive assembly for rotating the printing belt, a continuous loop shaped squeegee belt arranged within the interior space, a squeegee belt drive assembly for rotating the squeegee belt, the printing belt and the squeegee belt each having a planar portion opposing one another in spaced apart relationship, a source of radiation curable material in communication with the interior space, at least one squeegee attached to the squeegee belt, the squeegee having a distal end in operative association with the source of radiation curable material for transferring the material to the inner surface of the printing belt.

An apparatus for direct rotary printing a layer of radiation curable material onto a cylindrical surface of individual articles, the apparatus comprising a continuous loop shaped printing belt having an inner surface defining an interior space and an outer surface defining a printing surface, the outer surface oriented in a vertical plane for engagement with the cylindrical surface of the individual articles; a printing belt drive assembly for rotating the printing belt including a printing belt drive and a printing belt follower arranged in spaced apart relationship, and a motor for rotating the printing belt drive whereby the printing belt is rotated; a continuous loop shaped squeegee belt arranged within the interior space, the printing belt and the squeegee having planar portions opposing one another in spaced apart relationship; a squeegee belt drive assembly for rotating the squeegee belt including a squeegee belt drive and a squeegee belt follower arranged in spaced apart relationship, and a motor for rotating the squeegee belt drive whereby the squeegee belt is rotated; a source of radiation curable material arranged in communication with the interior space; at least one squeegee attached to the squeegee belt, the squeegee having a distal end in operative association with the source of radiation curable material for transferring the material to the inner surface of the printing belt for printing by the printing surface.

A process for applying a material in a pattern onto individual articles having a curved surface, the process comprising conveying the articles into operative association with a rotationally supported printing belt having a planar portion for contact with the curved surface of the articles for applying the material thereon, supplying material to the printing belt for application onto the articles, rotating the articles when in operative contact with the planar portion of the belt, rotating at least one squeegee having a path of travel along the planar portion of the printing belt, and applying the layer of material from the planar portion of the belt onto the curved cylindrical surface of the articles upon contact of the squeegee with the planar portion of the printing belt.

A process for applying a rotation curveable material in a predetermined pattern onto individual articles having a cylindrical surface, the process comprising conveying the articles into operative association with a rotationally supported loop-shaped printing belt having a planar printing portion for contact with the cylindrical surface of the articles for applying the material thereon in the pattern, supplying material to an inner surface of the printing belt opposing the pattern for application onto the articles, rotating the articles when in operative contact with the planar printing portion of the printing belt, rotationally supporting at least one squeegee on a loop shaped squeegee belt having a planar portion opposing the planar printing portion, rotating the at least one squeegee by the squeegee belt, the squeegee having a distal end having a path of travel in contact with the planar printing portion of the printing belt, and applying the material from the planar printing portion of the printing belt onto the cylindrical surface of the articles upon contact of the squeegee with the inner surface of the planar printing portion of the printing belt.

BRIEF DESCRIPTION OF THE DRAWINGS

The above description, as well as further objects, features and advantages of the present invention will be more fully understood with reference to the following detailed description of an apparatus and method for direct rotary printing compositions onto cylindrical articles, when taken in conjunction with the accompanying drawings, wherein.

DETAILED DESCRIPTION

In describing the preferred embodiments of the present invention, specific terminology will be resorted to for the sake of clarity. However, the invention is not intended to be limited to the specific terms so selected, and is to be understood that each specific term includes all technical equivalence which operate in a similar manner to accomplish a similar purpose.

Figure 1:
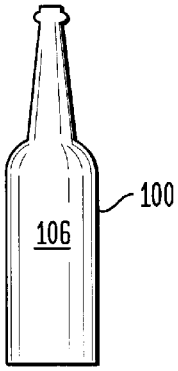
FIGS. 1–3 are front elevational views of various articles in the nature of glassware having cylindrical portions for decorating by printing pursuant to the apparatus and method of the present invention.
Figure 2:
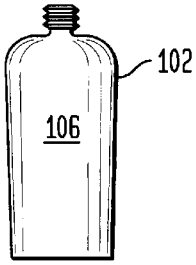
Figure 3:
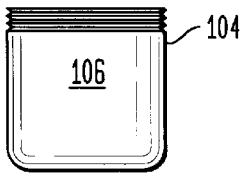

Referring to the drawings, wherein like reference numerals represent like elements, there is shown in FIGS. 1–3 a variety of articles for decorating or otherwise printing in accordance with the apparatus and method of the present invention using a radiation curable composition. The apparatus and method of the present invention is particularly suitable for the glassware decorating industry where various glass substrates, e.g., glass bottles and the like are decorated with one or multiple registered layers of the UV radiation curable composition. In this regard, the glass substrates to be decorated have a generally cylindrical shape provided with at least one cylindrical portion to receive the decorative printing in a desired pattern.

In FIG. 1 there is shown a glass beverage bottle 100, in FIG. 2 a glass perfume and/or cosmetic-type bottle 102, and in FIG. 3 a glass wide mouth bottle 104. Each of the bottles 100, 102, 104 are provided with a cylindrical surface 106 to receive various patterns in the nature of graphic designs, textual material, etc. in one or more layers of various colors using radiation curable compositions in accordance with the apparatus and method of the present invention. However, the apparatus and method of the present invention is also suitable for substrates other than glass, for example, plastic and ceramic, which may include other types of containers such as cups, dishes, vases and other decorative glassware; and other cylindrical shaped articles to which there is a desire to provide a printed layer for decorative or functional purposes.

Examples of UV radiation curable compositions suitable for use in the present invention are described in Kamen, et al., U.S. Pat. Nos. 5,571,359 and 5,487,927 which compositions and applications are incorporated herein by reference. In general, these radiation curable compositions contain a radiation curable component which may be monomers, oligomers, or low molecular weight homopolymers, copolymers, terpolymers, graft copolymers or block copolymers, so long as the component is cured (polymerized) by exposure to electron beam, actinic or ultraviolet radiation. The radiation curable component is capable, after curing, to bind to the substrate to which it is applied to a degree sufficient to be commercially acceptable for decorating purposes. This means that the composition must be permanently affixed to the substrate to a degree sufficient to remain on the substrate for the useful life of the substrate. For example, where the substrate is a container containing nail enamel, the composition must remain on the container throughout the useful life of the nail enamel and remain resistant to the solvents and other ingredients found in nail enamel compositions. In the preferred composition, the radiation curable component is curable by ultraviolet radiation having a wavelength of 4 to 400 nm, and preferably 325 to 365 nm. In the case of actinic radiation, the radiation curable component is curable by actinic radiation having the wavelength of 4–600 nm.

UV radiation curable compositions having high performance adhesion suitable for beverage bottles are known from U.S. Pat. No. 5,656,336, which patent is assigned to the same assignee of the present application. Also, UV radiation curable compositions for beverage bottles which are formulated to be removed upon exposure to an alkali solution are known from U.S. Pat. No. 6,093,455 which patent is assigned to the same assignee of the present application. The disclosures in the aforementioned '336 Patent and '455 Patent are incorporated herein by reference.

The cure rate of UV ink compositions or coatings are dependent on the monomers, the concentration of the different monomers in the formula, initiation systems and the concentration of initiators, as well as the light intensity and wavelength. The necessary UV dose (energy) for curing a given UV curable coating or ink formula is constant in certain conditions. The full cure of a coating film is defined by the reacting of all active groups (acrylate double bonds, vinyl ether double bonds or epoxy functional groups) in the formula. A half or partial cure of the UV coating is defined by formation of a solid film with tack free surface in which the active functional groups are not completely reacted. The UV dose for a half cured coating film can be detected by a UV radiometer, e.g. the measurement of the same amount of energy used for obtaining tack free surface coating. The unit of half cure UV dose is energy irradiated on unit area (for example $mj/cm^2$). The half cure UV dose for different formulas can range from, as low as, 40 $mj/cm^2$ for acrylates system to 1,000 $mj/cm^2$ or more for epoxy, cationic photo initiation system. The preferred radiation curable compositions of the present invention include cationic UV curing inks as described in the aforementioned '359, '927, '455 and '336 Patents.

The printing apparatus of the present invention includes at least one, and preferably a plurality of sequential screen printing workstations. It is to be understood that any number may be provided within the apparatus, depending on the desired patterns and colors to be printed. At each printing workstation, there is provided a screen printing assembly in the nature of a rotary screen printing device. Generally, each of the rotary screen printing assemblies include a continuous belt type printing screen through which a radiation curable composition is applied in the desired pattern to an underlying article by means of an internal squeegee device. The screen printing device includes a continuous soft or flexible belt type printing screen rotationally supported about a pair of spaced apart journals. The belt includes a planar portion for contact with the cylindrical surface of the articles for directly printing a layer of the radiation curable material thereon. The printing screen may be rotated continuously, intermittently, or remain stationary during the printing operation. This construction of the rotary screen printing device therefore includes a printing screen of generally greater length than a cylindrical printing screen. This enables the provision of a greater number of images to be screen printed within a single screen printing workstation.

The articles to be decorated, which in one disclosed embodiment are beverage bottles, are transported through the apparatus from a supply thereof into registration with each of the screen printing assemblies by means of a conveyor system. Each of the screen printing assemblies is adapted to print an inked image of a color or texture, the same or different than the images to be printed by the remaining screen printing assemblies. The inked images may be registered to provide different resulting patterns, for example, partially or fully overlapping one another when decorating an article, as well as text material.

The image to be printed is first engraved or otherwise provided on the printing screen. By way of one example, the printing screen may be initially coated with a light sensitive lacquer. After exposing a film of the required image onto the lacquered printing screen, the light sensitive lacquer is washed away and the printing screen is ready for use. The squeegee device is operative for internally pressing the radiation curable composition through the perforated printing screen onto the surface of the articles to be decorated. Ink deposits can be varied by varying the pressure applied by the squeegee device.

It is contemplated that one or more of the same or different images may be formed in the printing screen for transfer to the surface of an article during operation of the screen printing assembly. Briefly in this regard, the screen printing assembly is preferably arranged for rotation of the belt in a vertical plane. However, the belt can also be arranged in a horizontal plane. In operation, the screen printing assembly may be rotated either intermittently, or preferably continuously, as well as being held stationary during the screen printing process. By continuous rotation, it is contemplated that the maximum production rate for the screen printing apparatus can be achieved. During rotation of the screen printing assembly, the squeegee device may be held stationary, rotated in the opposite direction, or rotated in the same direction at a different speed. The screen printing assembly can be provided with planar printing portions in a variety of lengths.

Figure 4:
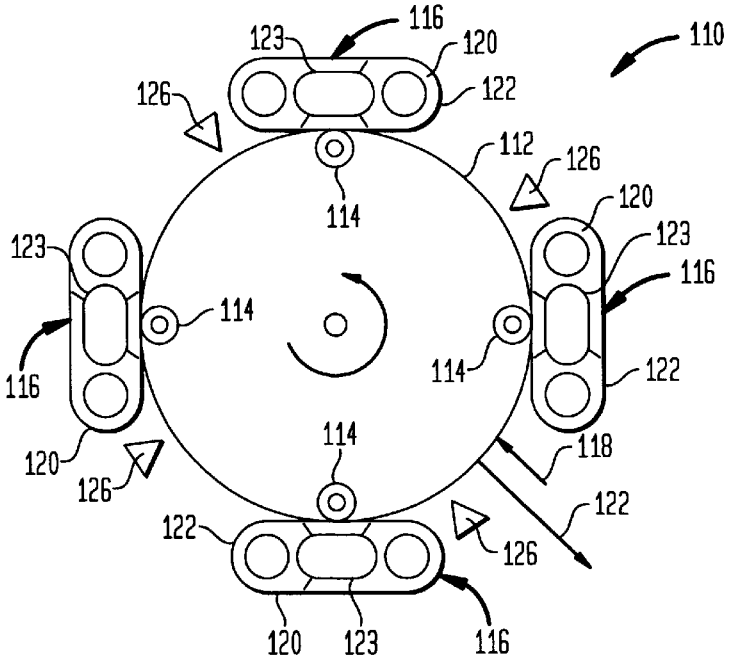
FIG. 4 is a diagrammatic illustration of a turntable arrangement for transporting beverage bottles past a plurality of screen printing assemblies in accordance with one embodiment of the present invention.

There is shown in FIG. 4 a diagrammatic illustration by way of one example a four color screen printing apparatus generally designated by reference numeral 110. It is to be understood than any greater or lesser number of color printing station may be incorporated into the apparatus and method of the present invention. The printing apparatus 110 is provided with a turntable 112 of known construction which is incorporated into the present invention to transport articles 114 past a plurality of screen printing stations 116 in a continuous or intermittent motion. One suitable turntable 112 is available from Krones, Inc. of Franklin, Wis. See also turntables disclosed in U.S. Pat. Nos. 4,798,135 and 3,783,777, the disclosures of which are incorporated herein by reference. Articles 114 to be screen printed are supplied to the turntable 112 in a conventional manner, for example, at location 118 in a vertical orientation. The articles 114 are transported about a circular path via the turntable 112 past the plurality of screen printing stations 116 where, for example, a separate color of printing ink can be screen printed onto each of the articles. In addition, a hot stamping operation can also be performed if desired. In any event, the articles 114 while being transported by the turntable 112 are rotated in either a clockwise or counterclockwise direction as they pass each of the screen printing stations 116.

At each of the screen printing stations 116, there is provided a rotary screen printing assembly 120 of the belt type as thus far described which includes a continuous soft or flexible printing screen 122 and a squeegee assembly 123. Although the printing screen 122 may be rotated in either a clockwise or counterclockwise direction, it is preferred that the printing screen be rotated in a direction opposite to that of the rotation of the article 114 during the screen printing operation. In this regard, the relative rotational speed between the article 114 and printing screen 122 at their point of contact, i.e., tangent line, is zero.

In order to achieve high production rates, it is preferred that the articles 114 be transported through the screen printing apparatus 110 in a high speed continuous uninterrupted motion while the squeegee assembly 123 and printing screen 122 are continuously rotated. In other words, the articles 114 to be screen printed are brought into contact with each squeegee assembly 123 as the articles are transported therepast along a circular path via the turntable 112 in a continuous motion. This is distinguished from indexing where the articles 114 are momentarily stopped during the screen printing operation. In the case of continuous motion, it is contemplated that there is the possibility of smudging of the screen printed inked pattern resulting from the forward or continuous motion of the articles 114 as they are brought into contact with the squeegee assembly 123, which although rotating, is held at a stationary position relative to the article being printed. This can therefore occur even though the articles 114 and squeegee assembly 123 are both in motion, they are moving in a manner to provide relative nil speed therebetween during the printing process. It is therefore desirable to provide zero relative forward and backward motion between the articles 114 and squeegee assembly 123 during the screen printing operation to prevent possible smudging and to ensure the greatest definition and detail of the pattern to be screen printed. In some circumstances, a mismatch in speed between the article 114 and the squeegee assembly 123 may be desirable to accommodate needed copy modification.

The turntable 112 is rotated in the opposite direction as the rotation of the printing screen 122, either clockwise or counterclockwise. In addition, the linear speed of rotation of the turntable 112 and printing screen 122 are synchronized to be the same.

The articles 114 having a generally cylindrical configuration may be screen printed at rates in excess of 250 bottles per minute, and at rates in a range of 500–700 bottles a minute, and optimally up to 1000 bottles per minute. It is, however, to be understood that lower production rates are also contemplated in accordance with the present invention, i.e., rates less than 250 bottles per minute. This is accomplished by means of the use of the rotary screen printing assembly 120 in combination with radiation curable compositions. The higher production rates are particularly achieved by orienting the screen printing assembly 120 in a vertical orientation. In this regard, articles 114 to be screen printed do not have to be reoriented from their vertical orientation to a horizontal orientation for screen printing.

It can be appreciated that it is desirable to ensure that the inked image printed by one of the screen printing assemblies 120 is at least partially dried or cured before a second colored inked image is printed over the first image. Otherwise, interaction between the two differently colored inks may cause the colors to run or bleed, and the sharpness of the outline or contour of the composite image will be diminished. Furthermore, a portion of the ink which remains wet on the article 114 may adhere to the printing screen 122 of the next adjacent, downstream screen printing assembly 120, thereby causing further interaction of the inks, as well as other related problems.

In accordance with one embodiment of the present invention, the freshly applied outer surface of the inked image is at least partially cured by means of a radiation emitting source such as a UV lamp 126 located at or between each of the screen printing stations 116. Each of the UV lamps 126 is preferably positioned in the space between the screen printing stations 110, 112 as shown in FIG. 4. As each article 114 is conveyed away from the printing screen 122, the inked image is exposed to the UV radiation emitted from the adjacent UV lamp 126 for a sufficient duration to at least partially cure the outer surface of the applied inked image. In this manner, the applied inked image may be at least partially cured prior to the articles 114 being advanced to the next screen printing station 116. As previously noted, the radiation source may be other than UV radiation, for example, actinic radiation, electron beam, microwave radiation and/or infrared radiation supplied from a suitable source thereof.

It is preferred that the inked image printed by one of the rotary screen printing assemblies 120 be at least partially cured before a second image is printed over the first image. It is therefore not required that the inked image be completely cured at each screen printing station 116. As long as the applied inked image is at least partially cured, the inked image will not run or bleed and the sharpness of the outline or contour of the composite image will be preserved during subsequent screen printing of the next image at an adjacent screen printing station 116. The curing of the applied inked image may be enhanced by raising the surface temperature of the articles 114 prior to the screen printing process. In this regard, an infrared lamp may be positioned at each screen printing station 116 in advance of each rotary screen printing assembly 120. The infrared lamp will raise the surface temperature of the articles 114 in the range of about 300–350° F.

The UV source 126 can also be located at a remote location outside the screen printing apparatus 110. The UV source, for example, may comprise a laser radiation device emitting the appropriate wavelength for curing the applied inked image. The emitted laser radiation may be conducted to each of the screen printing assemblies 120 by means of a fiber optic bundle, a light pipe available from Fusion Technologies, Inc. or the like. The fiber optic bundle terminates at location overlying the decorated articles. The fiber optic bundle may be divided so as to transmit the radiation to each of its designated locations, for example, between each of the screen printing stations 116. The apparatus 110 has been described using a single laser to transmit radiation to each of the screen printing assemblies 120. In addition, a plurality of individual lasers, one for each screen printing station 116 may be provided in accordance with the present invention.

Figure 5:
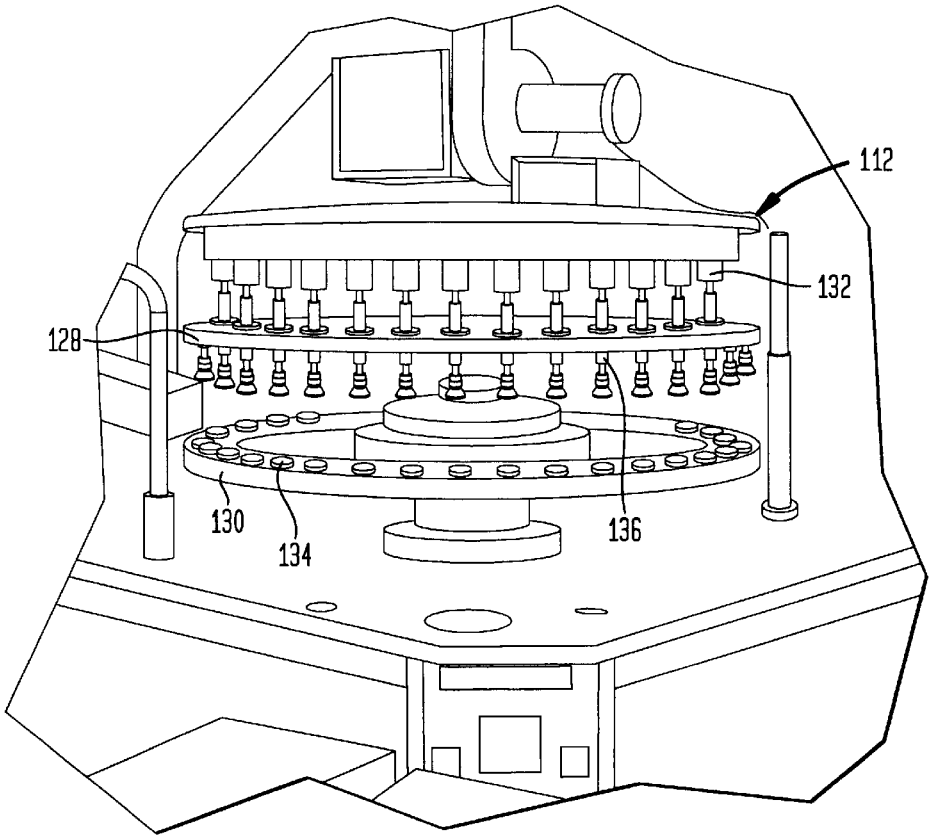
FIG. 5 is a perspective illustration of a turntable for moving articles into operative association with one or more printing assemblies.
Figure 6:
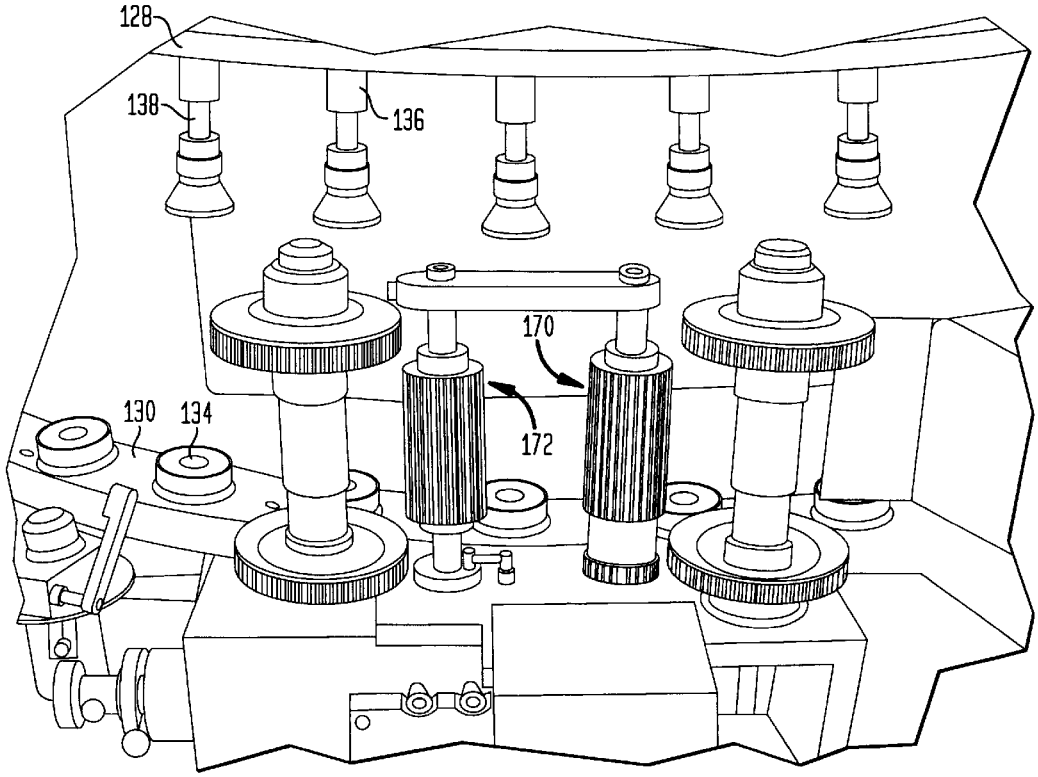
FIG. 6 is a perspective illustration of a portion of the turntable and showing a printing assembly.
Figure 7:
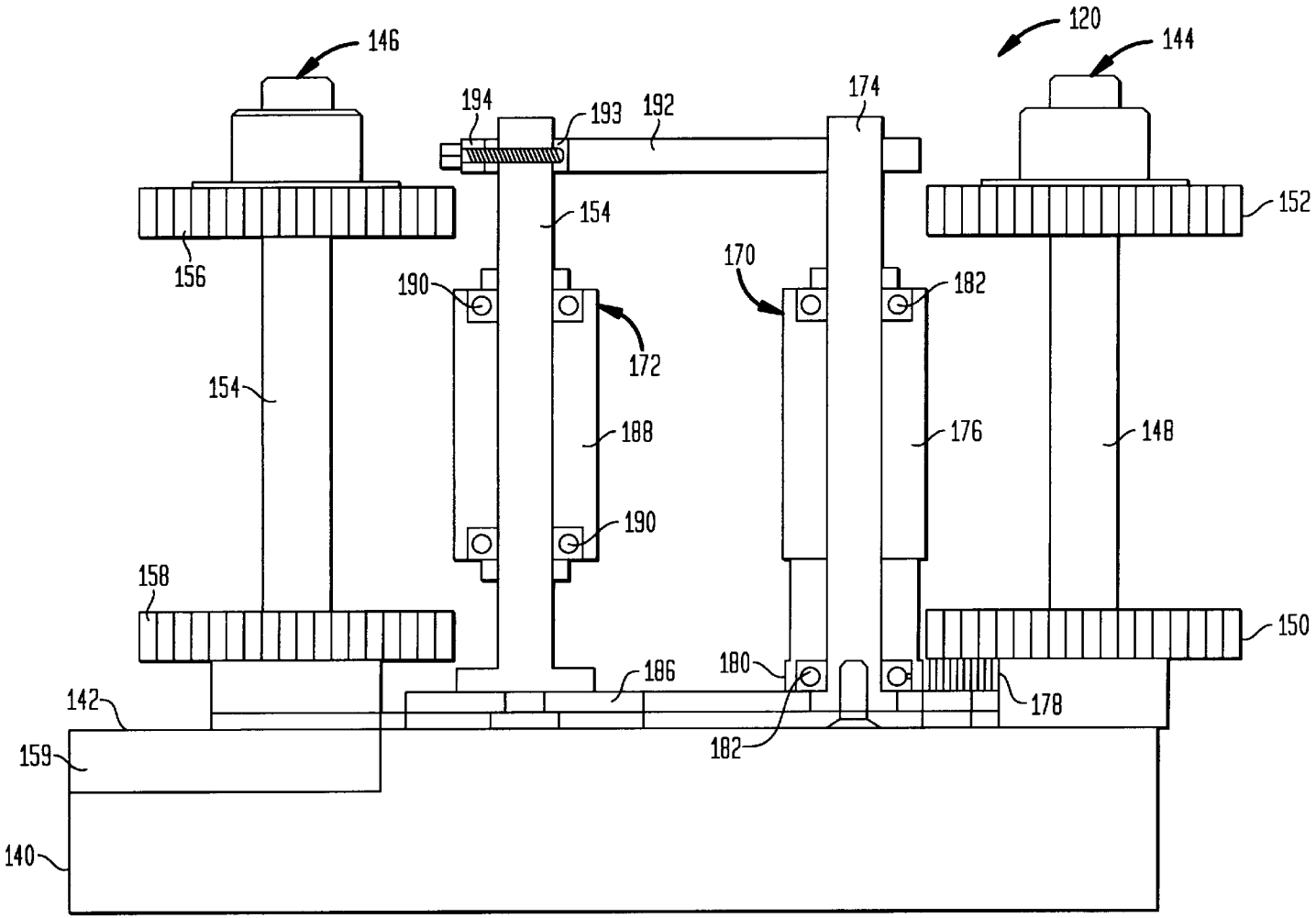
FIG. 7 is a diagrammatic illustration of a printing assembly constructed in accordance with one embodiment of the present invention.
Figure 8:
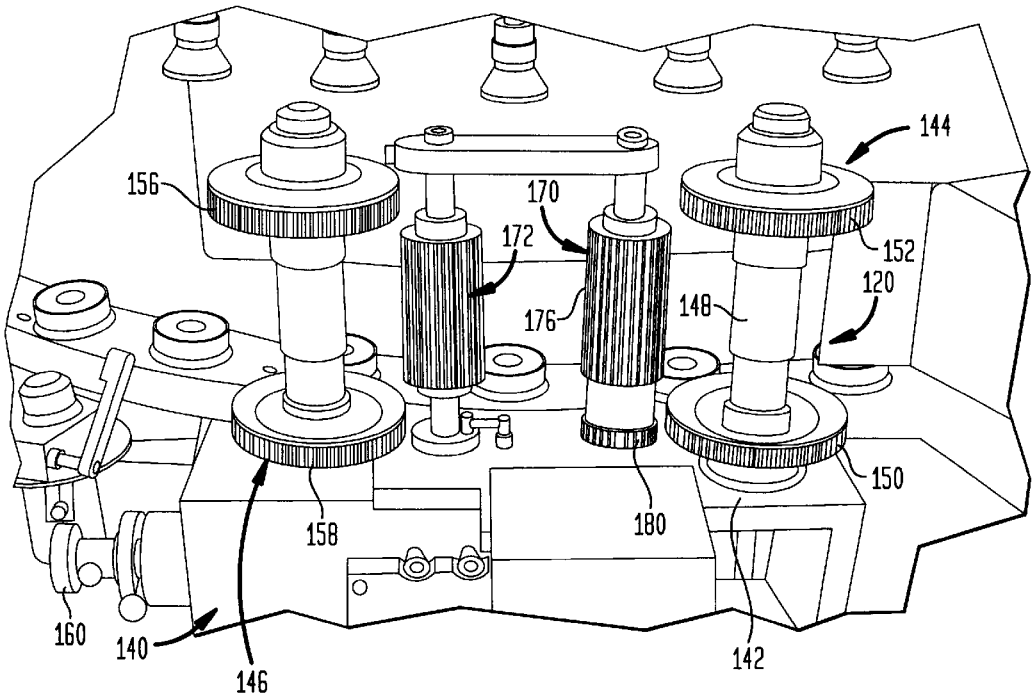
FIG. 8 is a perspective illustration of a printing assembly constructed in accordance with one embodiment of the present invention.

Referring to FIGS. 5 and 6, there is illustrated the turntable 112, also known as a turret, which as previously noted is available from Krones of Franklin, Wis. The turntable is generally constructed to include upper and lower circular supports 128, 130 which are simultaneously rotatable about a common vertical axis to provide the circular path of travel for the articles 114. Circumferentially positioned between the upper and lower supports 128, 130 are a plurality of article fixtures generally designated by reference numeral 132. Each fixture 132 includes a lower article support 134 attached to the lower support 130 and an upper article support 136 attached to the upper support 128 as best shown in FIG. 6. The upper and lower articles supports 134, 136 are arranged in collinear alignment to form a space therebetween adapted to receive an article 114 to be printed pursuant to the apparatus and method of the present invention.

The lower article support 134 is operative for receiving and/or supporting the lower end of an article 114. The upper article support 136 is provided with a longitudinally reciprocal and rotatable member 138. The end of member 138 is constructed to engage the upper end of the articles 114 thereby maintaining the position of the articles with respect to the lower article support 134. In this regard, member 138 may be retracted to allow positioning of an article between the lower and upper article supports 134, 136. By extending member 138, the article will be retained in a vertical position at a circumferential portion of the turntable 112. By rotating members 138, the articles 114 can be rotated about their longitudinal axis at any desired speed. To facilitate rotation, the lower article support 134 may be provided with bearings to allow for its rotation while supporting the articles 114. The turntable 112 advances the articles generally about a circular path such that the outer surface of the articles 114 will be positioned relative to the printing screen 122 for printing an image thereon as previously and hereinafter described. The foregoing description of the turntable 112 is for illustrative purposes. It is to be understood that the turntable 112 is commercially available from a number of sources. Accordingly, the detailed construction and operation of the turntable 112 is well known to those skilled in the art, and as such, a further description is not required for a complete understanding and disclosure of the apparatus and method of the present invention.

The articles 114 to be decorated are transported to the turntable 112 in preferably a vertical orientation as opposed to the horizontal orientation which requires their reorientation. The articles 114 are fed from a supply in the vertical orientation with respect to their longitudinal axis. By printing the articles 114 in a vertical orientation, it is not required to first reorient the articles in a horizontal printing orientation from their normal vertical supply orientation, and then to reorient the articles into a vertical discharge orientation after the screen printing operation. By eliminating the reorientation steps for the articles 114, the production rate of the screen printing apparatus is increased.

Referring now to FIGS. 6–10, there will be described the construction of a printing assembly 120 in accordance with one embodiment of the present invention. The printing assembly 120 includes a base housing 140 having a top surface 142 from which there upwardly extends in spaced apart relationship a belt drive 144 and a belt follower 146. The belt drive 144 includes a drive rod 148 arranged transverse to the top surface 142 of the base housing 140. The drive rod 148 supports a pair of spaced apart timing gears 150, 152 whereby rotation of the drive rod will effect simultaneous rotation of one or both of the timing gears. The drive rod 148 can be coupled within the base housing 140 to a suitable drive assembly, for example, a servo motor via any suitable coupling means. Accordingly, the belt drive 148 can be rotated about its longitudinal axis at a fixed location at a desired speed. It is also contemplated that timing gear 150 may be rotated directly or indirectly by a drive gear (not shown) coupled to a motor or other suitable rotatable assembly of gears and/or belts.

The belt follower 146 includes a follower rod 154 arranged transverse to the top surface 142 of the base housing 140. A pair of timing gears 156, 158 are rotationally supported in spaced apart relationship on the follower rod 154. The corresponding timing gears 150, 152, 156, 158 are arranged in horizontal alignment. In this regard, timing gears 150, 158 are arranged in a first horizontal plane, while timing gears 152, 156 are arranged in a second horizontal plane, which second plane is parallel spaced from the first horizontal plane. The belt follower 146 is displaceable in a lateral direction to and away from the belt drive 144, as well as being lockable in fixed position by any suitable locking assembly. By way of example, the belt follower 146 may be supported on the base housing 140 by a mechanical slide generally designated 159 in FIG. 7 for manipulation of the belt follower laterally to and from the belt drive 144. The mechanical slide 159 may be manipulated by an external control knob 160 which can also be rotated to obtain fine positional adjustment of the belt follower 146. The position of the mechanical slide may be locked rigidly in fixed position by a suitable mechanical carriage locking lever 162. By rotating the locking lever 162 in one direction, the mechanical slide 159 will be released to enable its displacement, while rotating the locking lever in the opposite direction will secure the mechanical slide in fixed position. Mechanical slides and locking assemblies are generally known to those skilled in the art.

As will be described hereinafter, the printing screen 122 is positioned circumferentially about the belt drive 144 and belt follower 146 for rotation thereabout while being maintained under tension. As such, the belt follower 146 is designed to be displaceable towards the belt drive 144 whereupon the printing screen 122 can be positioned about the belt drive and follower. After positioning, the belt follower 146 may be displaced away from the belt drive 144 to apply sufficient tension to the printing screen 122 as required for the printing process. The belt follower 146 will be subsequently locked in position to maintain the printing screen 122 under tension during operation of the printing assembly 120. It can be appreciated that any number of various mechanical, hydraulic, electric or other mechanisms may be incorporated for use to allow for the movement of the belt follower 146 and its releasable locking in fixed position. Assemblies of the foregoing type are well known in the art for accomplishing the intended purpose as thus far described. Accordingly, the screen printing station 116 incorporates any one of the foregoing assemblies.

Figure 10:
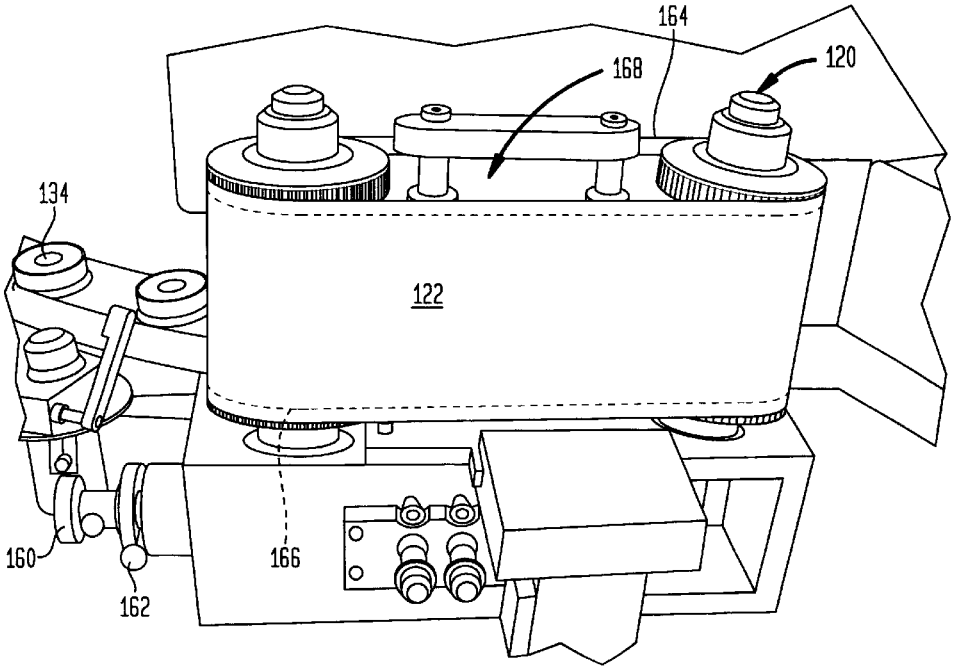
FIG. 10 is a perspective illustration of a printing assembly constructed in accordance with one embodiment of the present invention.

As shown in FIG. 10, the printing screen 122 is in the form of a continuous belt as thus far described. The inner lateral edges of the printing screen 122 are formed with a plurality of teeth. By way of one example, a pair of spaced apart timing belts 164, 166 are bonded to the inner peripheral edges of the printing screen 122 by any suitable means, such as the use of adhesives, stitching, thermal bonding, etc. The teeth of the timing belts 164, 166 will mate with the teeth on their corresponding timing gears 150, 152, 156, 158. Upon rotation of the belt drive 144, the printing screen 122 will be rotated. It is also contemplated that teeth may be integrally formed along the peripheral edges of the printing screen 122.

The belt drive and follower 144, 146 define a clearance 168 therebetween. Positioned within the clearance 168 is the squeegee assembly 123 which includes a squeegee drive 170 and a squeegee follower 172. The squeegee drive 170 includes a generally fixed support rod 174 to which there is rotationally supported an elongated timing gear 176. The timing gear 176 is adapted for rotation about its longitudinal axis about the support rod 174. In this regard, the timing gear 176 can be rotated at a desired speed by a suitable servo motor positioned within the base housing 140. The timing gear 176 is rotated directly about the support rod 174 by means of a drive gear 178 which is meshed with a driven gear 180 provided at the lower end of the timing gear 176. The driven gear 180 may be integrally formed at the lower end of the timing gear 176. In this regard, the combined or integrally formed timing gear and driven gear 176, 180 are rotationally supported about the support rod 174 by means of spaced apart bearings 182. Other suitable assemblies for rotating the timing gear 176 may be incorporated into the present invention.

The squeegee follower 172 includes a support rod 184 having one end coupled to a slide mechanism 186. The slide mechanism 186 enables the squeegee follower 172, like belt follower 146, to be laterally displaced to and away from the squeegee drive 170. An elongated timing gear 188 is rotationally supported about the support rod 184 by means of a pair of spaced apart bearings 190. The timing gears 176, 188 have longitudinal rotational axes which are parallel to one another in a vertical orientation, and generally parallel to the longitudinal axes of the belt drive and follower 144, 146. Timing gears 176, 188 are generally of the same length.

The upper ends of the support rods 174, 184 are held in place by an elongated bracket 192 having an opening at one end into which the support rod 174 is secured. The other end of the bracket 192 is provided with an elongated opening 193 through which the support rod 184 extends. A bolt 194 is threaded through a portion of the bracket 192 and through a threaded opening within the end of the support rod 184. By rotation of the bolt 194, the support rod 184 will be slid laterally towards and away from the squeegee drive 170. It can be appreciated that any number of various mechanical, hydraulic, electric or other mechanisms may be incorporated for use to allow for the movement of the support rod 184.

Figure 9:
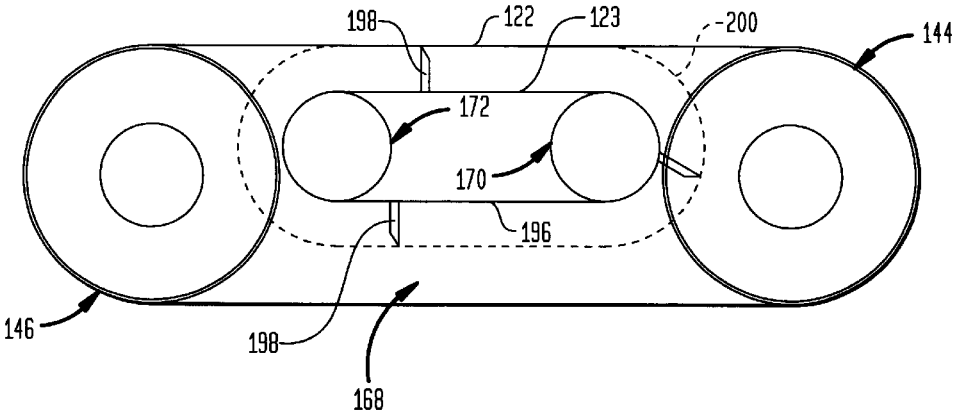
FIG. 9 is a diagrammatic illustration in plan view of a printing assembly constructed in accordance with one embodiment of the present invention.
Figure 11:
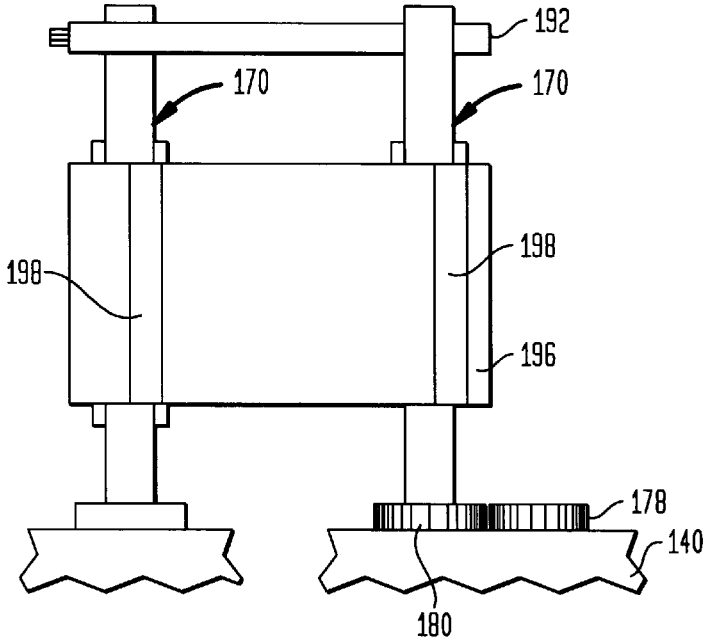
FIG. 11 is a diagrammatic illustration in front view of a squeegee assembly constructed in accordance with one embodiment of the present invention.

As shown in FIGS. 9 and 11, a timing belt 196 is positioned circumferentially about the timing gears 176, 188 and maintained under tension by turning bolt 194 to slide the squeegee follower 172 away from the squeegee drive 170. The timing belt 196 is generally the same width as the length of the timing gears 176, 188. One or more elongated squeegees 198 are affixed to the outer surface of the timing belt 196 by any suitable means such as adhesive bonding, thermal welding, mechanical fasteners and the like. Each squeegee generally extends transversely across the width of the timing belt 196. It is not required that there be one squeegee for each pattern to be printed from the printing screen 122. For example, each pattern may have more than one squeegee 198. In addition, it is contemplated that a lesser number for a plurality of patterns may be provided. For example, three squeegees 198 may accommodate five pattern images on the printing screen 122. Each of the squeegees 198 may be made of conventional construction of suitable flexible resilient polymer material and/or composites. For example, the tip of the squeegee 198 may be constructed of resilient polymer material, while the remainder of the squeegee may be constructed of a more rigid material, for example, metal, hard plastic, etc.

As shown in FIG. 9, the tip of each squeegee 198 is positioned to engage the inner surface of the printing screen 122 to effect the printing operation. The printing operation is achieved over the planar portion of the printing screen 122 which is generally defined between the belt drive and follower 144, 146. Within this planar portion, each squeegee 198 is moving in a longitudinal direction parallel to the plane of the printing screen 122 by the timing belt 196. The actual path of each squeegee 198 is shown by path 200, having both a linear and curved portion. The squeegees 198 are operative to effect screen printing during the linear path where it engages the planar portion of the printing screen 122. Accordingly, the squeegees 198 travel along a planar path which is coincident with the planar portion of the printing screen 122.

A flood bar 202 in the form of a moon-shaped scoop or an angular block is positioned within the clearance 168 formed by the printing screen 122. The flood bar is operative to dispense printing ink onto the inner surface of the printing screen 122 or directly to the squeegee 198. Ink is then passed through the printing screen 122 to articles 114 overlying the pattern image to be printed.

Figure 12:
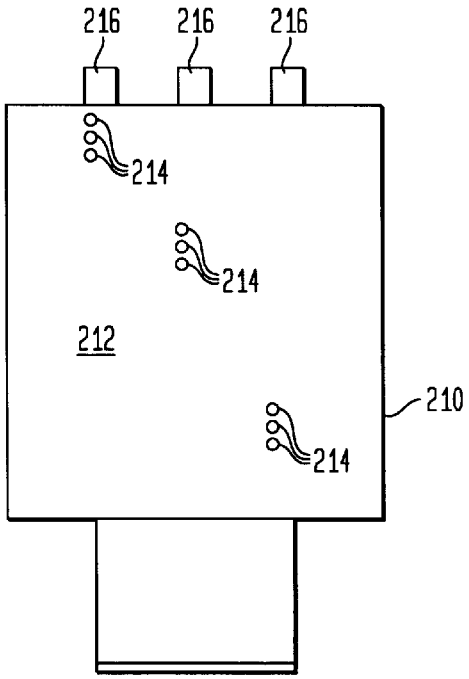
FIG. 12 is a front elevational view of an ink applicator block.
Figure 13:
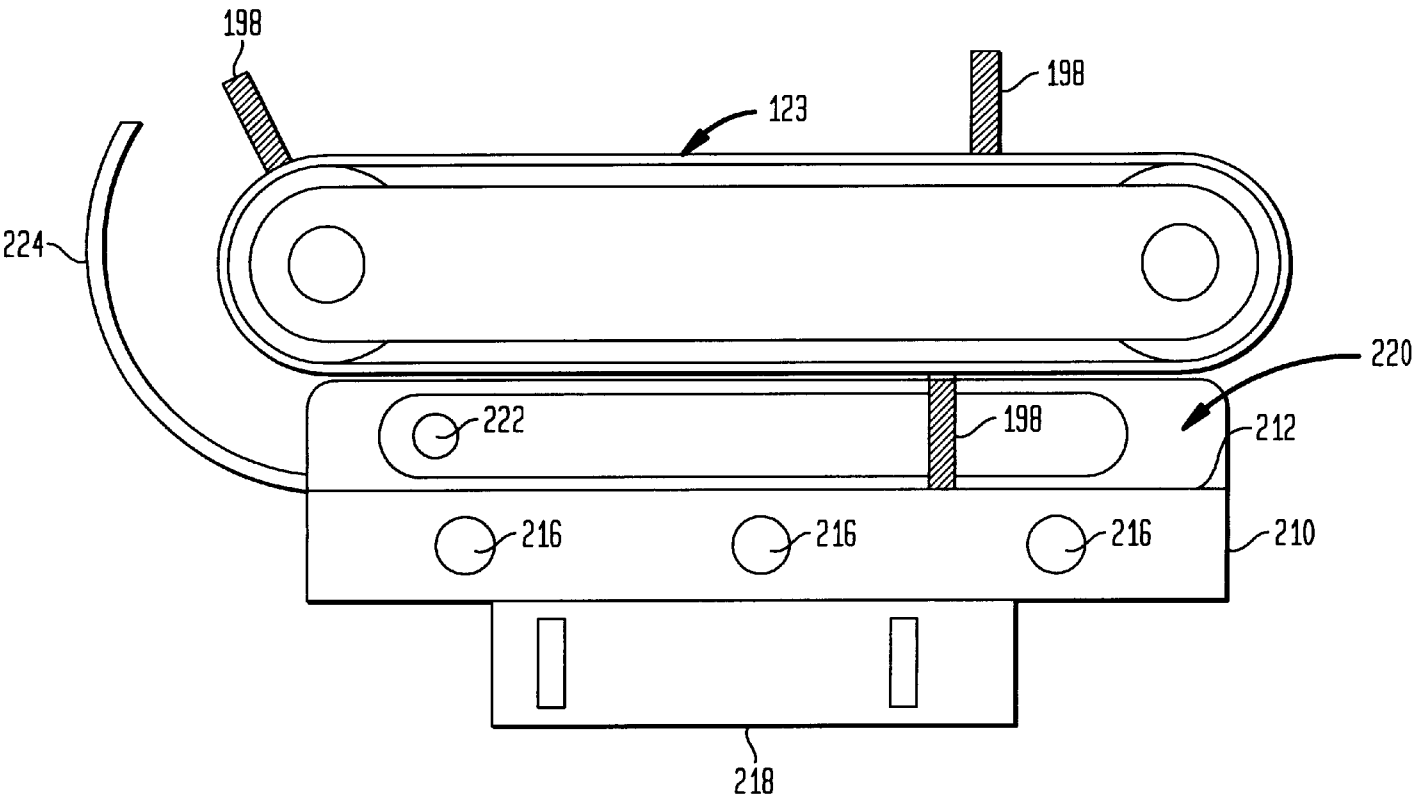
FIG. 13 is a top plan view of the ink applicator block in operative relationship with the squeegee assembly.

Referring now to FIGS. 12 and 13, there is disclosed the construction of an ink applicator block 210 in accordance with the preferred embodiment of the present invention. The ink applicator block 210 is constructed from a housing having a generally planar ink application surface 212 provided with a plurality of ink holes 214. The ink holes 214 are internally in communication through the ink applicator block 210 with one or more ink inlets 216. The ink inlets 216 may communicate with a group of holes 214, or all of the holes if desired. A supply of ink may be provided at a remote location and dispensed to the individual inlets 216 using any suitable means such as a pump and the like.

Referring to FIG. 13, the ink applicator block 210 is supported by a mounting bracket 218 with surface 212 in a vertical orientation. The mounting bracket 218 supports the ink applicator block 210 interiorally within the screen printing assembly 120 opposing the squeegee assembly 123. The surface 212 of the ink applicator block 210 is positioned such that the tip of each squeegee 198 will wipe the surface as the squeegee is moving therepast during operation of the squeegee assembly 123. As ink is being discharged onto the surface through holes 214, the squeegees 198 will pick up the ink and transfer same to the pattern on the printing screen 122. Excess printing ink will be captured in an ink recovery tray 220 generally positioned at the bottom of the ink applicator block 210. The ink recovery tray 220 includes an opening 222 for recirculating the captured ink to a supply thereof if so desired. After the squeegees 198 contact the printing screen 122, excess ink is removed by contact with curved wiper 224.

The rotary printing assembly 120 can be operated during the printing operation in a number of embodiments. For example, the printing screen 122 can be rotated while the squeegees 198 are similarly displaced or rotated by the timing belt 196, or the squeegees can be maintained stationary during the printing operation. It is also contemplated that the printing screen 122 may be maintained in a stationary position while the squeegees 198 are displaced or rotated by the timing belt 196. The articles 114 to be printed can be conveyed past each of the printing assemblies 120 in a continuous motion for high through put or through the printing apparatus by indexing to each of the printing assemblies if desired. During the printing operation, the articles 114 are rotated as the image is being printed from the printing screen 122.

In general, the printing screen 122 will be rotated at the same rate as rotation of the articles 114. Accordingly, the surface speed of the printing screen 122 relative to that of the articles 114 during the printing operation will be substantially zero. It is also contemplated that the linear speed of the printing screen 122 can be faster than the linear speed of displacement of the articles 112 past the rotary screen printing assemblies 120. It is further contemplated that the squeegees 198 can be rotated at the same rate as linear movement of the articles 114 past the rotary screen printing assemblies 120.

Although the rotary screen printing assemblies 120 have been disclosed as arranged in a vertical orientation, it is also contemplated that they can be arranged in a horizontal orientation. In this regard, the articles 114 will be conveyed into operative association with each of the assemblies, likewise, in a horizontal orientation by any suitable conveying device. More particularly, the rotary screen printing assemblies 120 as thus far described may be used where articles 114 are transported by a linear conveyor, either vertically or horizontally, as disclosed and described in the aforementioned '811 Application, the disclosure of which is incorporated herein by reference.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. An apparatus for printing a layer of material onto individual articles having a curved surface, said apparatus comprising a rotationally supported printing belt in the shape of a loop, said belt having an inner surface defining an interior region, a rotationally supported squeegee belt in the shape of a loop within said interior region, and at least one squeegee attached to said squeegee belt, said squeegee having a distal portion in operative association with the inner surface of said printing belt adapted for printing said material onto the surface of said articles.

2. The apparatus of claim 1, wherein said printing belt is rotationally supported at one end by a belt drive and at another end by a belt follower.

3. The apparatus of claim 2, further comprising a motor coupled to said belt drive for rotation thereof in a clockwise or counter-clockwise direction.

4. The apparatus of claim 3, further comprising a timing belt attached to an inner surface of said printing belt, said timing belt coupled to said belt drive and said belt follower for effecting rotation of said printing belt in response to the operation of said motor.

5. The apparatus of claim 4, wherein said printing belt has an outer surface arranged within a vertical plane.

6. The apparatus of claim 2, further comprising means for fixedly positioning one of said belt drive and said belt follower in a plurality of spaced apart positions with respect to each other.

7. The apparatus of claim 1, further comprising a source of material to be printed, said source arranged in said interior region in operative association with said squeegee.

8. The apparatus of claim 7, wherein said source comprises an applicator block having a surface and a plurality of holes in said block for discharging said material onto said surface, said distal portion of said squeegee arranged in operative association with said surface when rotated for transferring said material from said surface to said inner surface of said printing belt.

9. The apparatus of claim 7, wherein said material comprises radiation curable material.

10. The apparatus of claim 1, wherein said squeegee belt is rotationally supported at one end by a belt drive and at another end by a belt follower.

11. The apparatus of claim 10, further comprising a motor coupled to said belt drive for rotation thereof in a clockwise or counter-clockwise direction.

12. The apparatus of claim 10, wherein said squeegee belt comprises a continuous timing belt.

13. The apparatus of claim 10, further comprising means for fixedly positioning one of said belt drive and said belt follower in a plurality of spaced apart positions with respect to each other.

14. The apparatus of claim 1, further comprising a plurality of squeegees attached to said squeegee belt.

15. The apparatus of claim 1, wherein said distal portion of said squeegee, when in operative association with said inner surface of said printing belt, travels along a linear path.

16. The apparatus of claim 15, wherein said printing belt travels along a linear path opposing the linear path of said distal portion of said squeegee.

17. The apparatus of claim 16, wherein said linear paths are in a vertical orientation.

18. An apparatus for direct rotary printing a layer of radiation curable material onto a curved surface of individual articles, said apparatus comprising a continuous loop shaped printing belt having an inner surface defining an interior space and an outer surface arranged in a vertical plane, a printing belt drive assembly for rotating said printing belt, a continuous loop shaped squeegee belt arranged within said interior space, a squeegee belt drive assembly for rotating said squeegee belt, said printing belt and said squeegee belt each having a planar portion opposing one another in spaced apart relationship, a source of radiation curable material in communication with said interior space, at least one squeegee attached to said squeegee belt, said squeegee having a distal end in operative association with said source of radiation curable material for transferring said material to said inner surface of said printing belt.

19. The apparatus of claim 18, wherein said source comprises an applicator block having a surface and a plurality of holes for discharging said material onto said surface.

20. The apparatus of claim 18, wherein said printing belt drive assembly comprises a belt drive and a belt follower arranged in spaced apart relationship, and a motor for rotating said belt drive whereby said printing belt is rotated.

21. The apparatus of claim 20, wherein said printing belt is coupled to said belt drive and said belt follower by a timing belt attached to said printing belt.

22. The apparatus of claim 20, further comprising means for fixedly positioning one of said belt drive and said belt follower in a plurality of spaced apart positions with respect to each other.

23. The apparatus of claim 18, wherein said squeegee belt drive assembly comprises a belt drive and a belt follower arranged in spaced apart relationship, and a motor for rotating said belt drive whereby said squeegee belt is rotated.

24. The apparatus of claim 23, wherein said squeegee belt comprises a timing belt.

25. The apparatus of claim 23, further comprising means for fixedly positioning one of said belt drive and said belt follower in a plurality of spaced apart positions with respect to each other.

26. The apparatus of claim 18, further comprising a radiation-emitting device for at least partially curing said layer of radiation curable material.

27. An apparatus for direct rotary printing a layer of radiation curable material onto a cylindrical surface of individual articles, said apparatus comprising a continuous loop shaped printing belt having an inner surface defining an interior space and an outer surface defining a printing surface, said outer surface oriented in a vertical plane for engagement with the cylindrical surface of said individual articles; a printing belt drive assembly for rotating said printing belt including a printing belt drive and a printing belt follower arranged in spaced apart relationship, and a motor for rotating said printing belt drive whereby said printing belt is rotated; a continuous loop shaped squeegee belt arranged within said interior space, said printing belt and said squeegee belt having planar portions opposing one another in spaced apart relationship; a squeegee belt drive assembly for rotating said squeegee belt including a squeegee belt drive and a squeegee belt follower arranged in spaced apart relationship, and a motor for rotating said squeegee belt drive whereby said squeegee belt is rotated; a source of radiation curable material arranged in communication with said interior space; at least one squeegee attached to said squeegee belt, said squeegee having a distal end in operative association with said source of radiation curable material for transferring said material to said inner surface of said printing belt for printing by said printing surface.

28. The apparatus of claim 27, wherein said source comprises an applicator block having a surface and a plurality of holes for discharging said material onto said surface.

29. The apparatus of claim 27, further comprising a radiation-emitting device for at least partially curing said layer of radiation curable material.

30. The apparatus of claim 27, further including means for fixedly positioning one of said printing belt drives and said printing belt follower in a plurality of spaced apart positions with respect to each other.

31. The apparatus of claim 27, further comprising a plurality of squeegees attached to said belt.

32. A process for applying a material in a pattern onto individual articles having a curved surface, said process comprising conveying said articles into operative association with a rotationally supported printing belt having a planar portion for contact with said curved surface of said articles for applying said material thereon, supplying material to said printing belt for application onto said articles, rotating said articles when in operative contact with said planar portion of said belt, rotating at least one squeegee having a path of travel along said planar portion of said printing belt, and applying said layer of material from said planar portion of said belt onto the curved surface of said articles upon contact of said squeegee with said planar portion of said printing belt.

33. The process of claim 32, wherein said printing belt is rotated in the opposite direction to the direction of rotation of said articles.

34. The process of claim 32, wherein said rotation of said printing belt and said articles provides relative zero surface speed therebetween during said applying said layer of said material.

35. The process of claim 32, wherein said squeegee is rotated in the opposite direction of rotation of said printing belt.

36. The process of claim 32, wherein said material comprises radiation curable material.

37. The process of claim 36, wherein said material comprises UV curable material.

38. The process of claim 36, further including at least partially curing said radiation curable material.

39. The process of claim 32, further including arranging said printing belt in the shape of a continuous loop defining an interior region.

40. The process of claim 39, further including attaching said squeegee to a continuous loop shaped squeegee belt arranged within said interior region.

41. The process of claim 40, further including supplying said material to a distal portion of said squeegee for application to said printing belt during rotation of said squeegee belt.

42. The process of claim 40, wherein said squeegee belt has a planar portion parallel to said planar portion of said printing belt.

43. The process of claim 42, further including arranging said planar portions in a vertical orientation.

44. A process for applying a rotation curveable material in a predetermined pattern onto individual articles having a cylindrical surface, said process comprising conveying said articles into operative association with a rotationally supported loop-shaped printing belt having a planar printing portion for contact with said cylindrical surface of said articles for applying said material thereon in said pattern, supplying material to an inner surface of said printing belt opposing said pattern for application onto said articles, rotating said articles when in operative contact with said planar printing portion of said printing belt, rotationally supporting at least one squeegee on a loop shaped squeegee belt having a planar portion opposing said planar printing portion, rotating said at least one squeegee by said squeegee belt, said squeegee having a distal end having a path of travel in contact with said planar printing portion of said printing belt, and applying said material from said planar printing portion of said printing belt onto the cylindrical surface of said articles upon contact of said squeegee with the inner surface of said planar printing portion of said printing belt.

45. The process of claim 44, further including at least partially curing said radiation curable material.

46. An apparatus for printing a layer of material onto individual articles having a surface, said apparatus comprising a rotationally supported continuous closed path printing belt, said belt having an inner surface defining an interior region, a rotationally supported continuous closed path squeegee belt within said interior region, and at least one squeegee attached to said squeegee belt, said squeegee having a distal portion having a path of travel in operative association with the inner surface of said printing belt and adapted for printing said material onto the surface of said articles.

47. The apparatus of claim 46, wherein said printing belt is rotationally supported at one end by a belt drive and at another end by a belt follower.

48. The apparatus of claim 47, further comprising means for fixedly positioning one of said belt drive and said belt follower in a plurality of spaced apart positions with respect to each other.

49. The apparatus of claim 46, further comprising a source of material to be printed, said source arranged in said interior region in operative association with said squeegee.

50. The apparatus of claim 46, wherein said squeegee belt is rotationally supported at one end by a belt drive and at another end by a belt follower.

51. The apparatus of claim 50, further comprising means for fixedly positioning one of said belt drive and said belt follower in a plurality of spaced apart positions with respect to each other.

52. The apparatus of claim 46, wherein said distal portion of said squeegee, when in operative association with said inner surface of said printing belt, travels along a linear path.

53. The apparatus of claim 52, wherein said printing belt travels along a linear path opposing the linear path of said distal portion of said squeegee.

54. A process for applying a material in a pattern onto individual articles having a surface, said process comprising conveying said articles into operative association with a rotationally supported continuous closed path printing belt having a printing portion for contact with said surface of said articles for applying said material thereon, supplying material to said printing belt for application onto said articles, rotating said articles and said printing belt when said articles are at least in operative contact with said printing portion of said printing belt, rotating a continuous closed path squeegee belt having coupled thereto at least one squeegee, said squeegee having a path of travel along said printing portion of said printing belt, and applying said layer of material from said printing portion of said printing belt onto the surface of said articles upon contact of said squeegee with said printing portion of said printing belt.

55. The process of claim 54, wherein said printing belt is rotated in the opposite direction to the direction of rotation of said articles.

56. The process of claim 54, wherein said rotation of said printing belt and said articles provides relative zero surface speed therebetween during said applying said layer of said material.

57. The process of claim 54, wherein said squeegee is rotated in the opposite direction of rotation of said printing belt.

58. The process of claim 54, further including supplying said material to a distal portion of said squeegee for application to said printing belt during rotation of said squeegee belt.

59. The process of claim 54, wherein said squeegee belt has a planar portion parallel to a planar portion of said printing belt.

* * * * *